United States Patent [19]

Fulterer

[11] Patent Number: 4,552,415

[45] Date of Patent: Nov. 12, 1985

[54] ADJUSTABLE DRAWER MOUNTING ASSEMBLY

[75] Inventor: Manfred Fulterer, Lustenau, Austria

[73] Assignee: Fulterer Gesellschaft m.b.H., Lustenau, Austria

[21] Appl. No.: 636,398

[22] Filed: Jul. 31, 1984

[30] Foreign Application Priority Data

Aug. 3, 1983 [AT] Austria ..... 2814/83
Apr. 25, 1984 [AT] Austria ..... 1375/84

[51] Int. Cl.[4] ..... A47B 88/04

[52] U.S. Cl. ..... 308/3.8; 312/330 R; 312/341 R

[58] Field of Search ..... 308/3.6, 3.8; 312/330 R, 332, 341 R, 343, 344, 346

[56] References Cited

U.S. PATENT DOCUMENTS 4,121,876 10/1978 Ratti ..... 312/330 R

FOREIGN PATENT DOCUMENTS 2325236 12/1974 Fed. Rep. of Germany .
8028224 5/1981 Fed. Rep. of Germany .

*Primary Examiner*—Stuart S. Levy
*Assistant Examiner*—David Werner
*Attorney, Agent, or Firm*—Toren, McGeady, Stanger, Goldberg & Kiel

[57] ABSTRACT

A drawer is slidably mounted by a longitudinal rail member which has a horizontally extending support flange mounted beneath the drawer on one side thereof, the support flange having at least one lug which is deformable relative to the horizontal plane of the support flange, with deformation of the lug operating to enable adjustment of the position of the drawer relative to the base member upon which it is slidably mounted by the rail member.

13 Claims, 14 Drawing Figures

ADJUSTABLE DRAWER MOUNTING ASSEMBLY

The present invention relates generally to mounting hardware for a drawer and more specifically to an assembly for slidably mounting a drawer on a base member and for enabling easy adjustment of the position of the mounted drawer.

More particularly, the invention relates to the type of mounting hardware which consists of at least one longitudinal rail member which may have either an L- or a Z- shaped cross-sectional profile and which is supported so as to be slidable with respect to the base member, with the drawer being supported upon a horizontal side of the rail member by means of fastening screws which project through bores in the rail member and into the drawer.

In the prior art, German OS No. 27 50 086 discloses a kitchen cabinet having a basket structure which can be pulled out and having a front pullout door. The front pullout door is supported at pullout rails which are installed in pairs at the side walls of the kitchen cabinet in the horizontal position. The pullout doors and the basket structure are connected with one another and, additionally, an adjusting device enabling vertical adjustment is provided between the doors and the basket structure. The basket structure is supported so as to be pivotable with its rear side on the pullout rail and it lies with its front side on the vertically adjusting device. This adjusting device is constructed as a screw connection, i.e., as a rotary part with a threaded pin which is screwed into an extension of the rail. This adjusting element has above the threaded pin a support flange provided for support of the basket carrying rail and the support flange has an upwardly limiting groove. This adjusting device which is disclosed to have a construction in the form of a rotary part is a rather complicated component.

Further prior art showing a similar construction is German Utility Model No. 80 28 224. Here, a threaded sleeve is provided as an adjusting element or vertically adjustable device and this sleeve has a central bore to enable insertion of a fastening screw. This threaded sleeve is screwed into a tapped hole in the front area of the horizontal side of an L-shaped drawer rail wherein the end of the threaded sleeve serves as a support for the side wall of the drawer. The threaded sleeve has at its underside a widely cantilevering collar with a milled edge. By rotating this collar, the threaded sleeve can be turned to a greater or lesser degree into the tapped hole whereby the supported area of the side wall of the drawer may be raised or lowered. A disadvantage of this device is that there is involved a complicated additional threaded sleeve. A further complication arises in that the actual support area of the device is only a relatively small annular surface which, during corresponding stress on the drawer, could be easily damaged as might occur even when the adjusting device is used as intended or when the fastening screw is tightened too strongly. The advantage of a construction such as this compared with the first mentioned construction of the prior art lies in that a correction of the vertical position is possible when, for some reason, the drawer is distorted because by means of this known construction, a tensile as well as compressive forces can be transferred to the drawer.

Another construction is disclosed in German OS No. 21 55 731 wherein, from the vertical web of a drawer rail of a pullout device, lugs with an L-shaped cross-section are bent out on which the drawer rests relatively freely. This structure permits a simple assembly of the drawer in that it only needs to be placed on these cantilevering L-shaped lugs. However, no adjusting or correction of the setting of the drawer is possible. Such a disadvantage of this known prior art construction is recognized in German OS No. 23 25 236 wherein a further development of this construction is suggested according to which it is possible to bend the L-shaped support lugs with a simple tool so that a subsequent correction of the position can easily be achieved. However, this positional correction is possible only to a very limited extent because with this construction it is not possible to introduce forces directly into the drawer in order to thereby force deformation of the drawer in case it is distorted.

Additionally, a construction known in the prior art according to Austrian Pat. No. 337 400 provides a pullout guidance for drawers having a vertically adjustable front rail section. This section is formed in that the profiled guide rail has at its vertical web and at one side a unilaterally open slot which separates a vertical web section and a side section from the remaining part of the guide rail. Although this construction is rather simple to manufacture, it has disadvantages in that due to the cut the bending resistance of the rail in the front area is considerably reduced and thereby impaired so that it is necessary to encounter random bending during use caused by the inherent load or also caused by forces acting from outside. Austrian Pat. No. 328 127 shows a similar structure where, in the drawer guidance, a rail is deformable in its entirety in the front area in that, after the front adjusting area of the rail, a cross-sectional weakening occurs which includes the rail in its entirety.

Based upon the known state of the art, the present invention is directed toward providing a construction which is arranged in such a way that vertical adjustment and correction in height can be simply accomplished and wherein, additionally, by means of the correcting device, forces can be introduced into the drawer itself by means of which the drawer may at least be deformable to a limited extent. Such drawers which represent industrially mass-produced products are often distorted perhaps due to large manufacturing tolerances or manufacturing inaccuracies or, also, because of the material, the individual parts of the drawer such as the front plate, side walls and bottom are not exactly at right angles to one another. This may result not only in an aesthetically unsatisfactory impression in the assembled piece of furniture, but also operating characteristics of the pullout support mechanism may be considerably impaired.

SUMMARY OF THE INVENTION

Briefly, the present invention may be described as a drawer mounting assembly for slidably mounting a drawer on a base member which comprises a longitudinal rail member having a horizontally extending support flange upon which the bottom of the drawer is mounted. The support flange includes lug means which are connected with the drawer and which may be deformed to enable adjustable movement of the drawer.

Thus, in accordance with the invention, the horizontal support flange is formed at a rear part thereof taken relative to the pullout direction of the drawer with a lug member which is vertically higher than the plane of the horizontal support flange and which projects upwardly therefrom and is attached to the bottom side of the drawer. Additionally, another lug member may be provided forwardly of the support flange and both lug members are attached to the bottom of the drawer with screws. In the forwardmost lug member, a resilient or rubber buffer member is provided with the fastening screw extending through the buffer member.

In a further aspect of the invention, a punched out section may be provided adjacent a lug member which enables the lug member to be bent so that the drawer which is attached to the support flange through the bendable lug member by a screw may be adjusted.

A further aspect of the invention involves a construction wherein the bore through which fastening screws are applied to attach the rail member to the underside of the drawer are located adjacent to the support lug member.

In a preferred embodiment, the resilient or rubber buffer element is formed with a through bore to receive a fastening screw and the rubber buffer member is held by the fastening screw so that it cannot become detached. Basically, it would also be possible to arrange the buffer member and the screw adjacent one another, but this is not considered to be advantageous since, in this way, the buffer member could easily be lost.

In order not to complicate the manufacturing process with a construction in accordance with the invention, it is also provided that a section of an L-shaped punchout extends at right angles and another section extends parallel to the pullout direction of the drawer. Such punchouts or cutouts can be incorporated and included in the course of the manufacturing steps without extraordinary effort.

In order to create the support lugs as bending resistant as possible, the section of the L-shaped cutout which extends parallel to the pullout direction is provided in the vertical web of the drawer rail, viewed in the assembly position. Thus, the moment of resistance of the cross-section which is important for bending is considerably increased as compared to such an embodiment in which the section of the L-shaped punchout or cutout which extends parallel to the pullout direction lies adjacent in the horizontal side and in the direct vicinity of the bending edge between this side and the vertical web. Due to the selection of the arrangement of the sections, the bending resistance of the support lugs can be varied in a relatively wide range and it can be adapted to the respective purpose of the drawer guidance.

It is advantageous to provide, between the first and second fastening screw, in the central area of the horizontal side, additional bendable support lugs formed by L-shaped punch cuts so that over the entire length of the rail, several such support lugs are provided by means of which the weight of the drawer can be distributed uniformly over the length of the rail member.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE PREFERRED EMBODIMENTS

Figure 3:
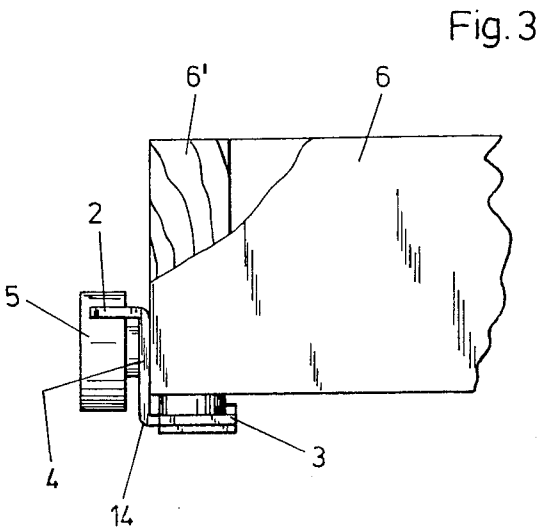
FIG. 3 is a front edge view of the assembly shown in FIG. 1.
Figure 1:
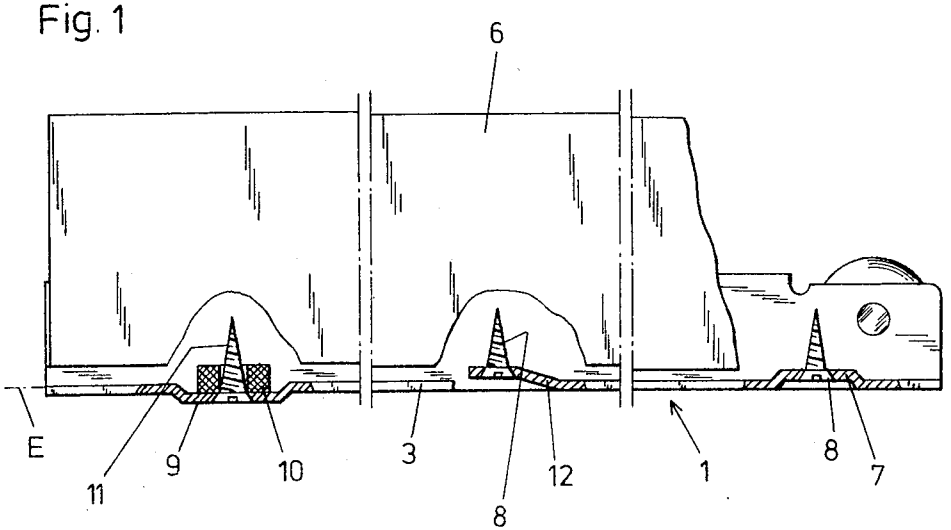
FIG. 1 is a side view of a drawer mounting assembly in accordance with the present invention wherein a rail member having a Z-shaped cross-section is utilized.
Figure 2:
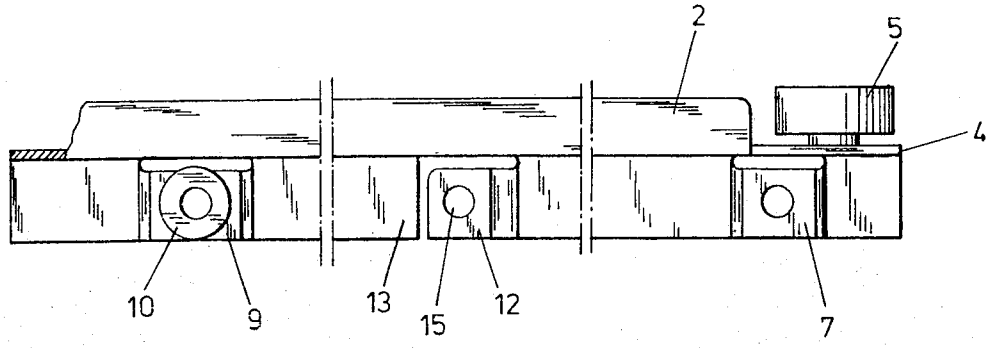
FIG. 2 is a top view of the rail member of FIG. 1 shown without the drawer.

Referring now to the drawings and particularly to FIGS. 1, 2 and 3 wherein there is shown a first embodiment of a drawer mounting assembly in accordance with the invention, the assembly is shown as comprising a rail member 1 which is one of several rails provided for mounting the drawer, the other rails not being shown in the drawing. The rail member 1 is formed with a profile which has a Z-shaped configuration in cross-section, best seen in FIG. 3, and the member 1 includes an upper horizontal side 2, a lower horizontal side 3 and a vertical web 4. The lower horizontal side 3 extends in a horizontal plane E and has mounted thereto the underside of a drawer 6, in a manner to be described more fully hereinafter. Thus, the horizontal side 3 operates as a support flange for the drawer 6. The assembly includes slider means which enable the drawer to be slidably mounted relative to a base member, such as, a piece of furniture or the like, and the slider means includes a rotatable roller 5 which is supported on the base member and upon which the rail member 1 is adapted to slide. The drawer 6 has a side wall 6' which, at the bottom side of the drawer, is supported on the support flange 3.

The support flange 3 has, at its rearward end, taken relative to the pullout direction of the drawer, in this case, in the area of the freely rotatable roller 5, a lug means in the form of an elevated lug member 7 which projects upwardly with respect to the horizontal plane E of the support flange 3. The elevation or lug member 7 has a bore extending therethrough with a fastening screw 8 projecting through the bore which may be turned in from the bottom into the side wall 6' of the drawer 6 in order to attach the lug member 7 to the bottom side of the drawer.

At the forward end of the support flange 3, there is provided a lug member 9 which is bent downwardly taken with respect to the plane E of the horizontal support flange 3. On this lug member 9, there is provided a resilient buffer member 10 which may be of rubber or other elastic material and which is penetrated by an additional fastening screw 11 which is also turned in from the bottom into the bottom side of the side wall 6' of the drawer.

Along the horizontal support flange 3 and between the lug member 7 and the lug member 9, at an appropriate length of the pullout drawer assembly, several bendable support lugs 12 may be provided which are formed by L-shaped cutouts or punch cuts 13 in the support flange 3. One section of the L-shaped cutout 13 extends at right angles to the pullout direction of the drawer and the other section of the cutout 13 extends parallel to the pullout direction of the drawer and lies directly adjacent to a bending edge 14 between the vertical web 4 and the horizontal support flange 3 of the rail member 1. The support lug 12 has an upper support surface with a bore 15 therein through which a fastening screw is supported with the lug member 12 being bent upwardly so that its actual support plane lies approximately at the level of the lug member 7.

In the assembly process of the drawer mounting assembly of the invention shown in FIGS. 1–3, the rail member 1 is attached to the underside of the side wall 6' of the drawer 6 by inserting the fastening screws 8 and 11 which operate as connector means affixing the lug members to the bottom side of the drawer. The screws 8 are turned in until they fit firmly and the screw 11 is only slightly tightened so that the rubber buffer member 10 will be under some compressive stress. If, after placing the drawer into the base member upon which it is to be slidably mounted, it is found that the drawer is distorted or that the drawer is not exactly positioned so that the front edges of the drawer extend horizontally, or in a case where several drawers are arranged one above another, there are uneven spaces between the drawers, this defect can be corrected by loosening or tightening the screw 11. Depending upon the direction of rotation of the screw 11, which is easily accessible from the bottom of the drawer, the rubber buffer 10 may be either stress-released whereby the underside of the drawer is somewhat raised or it may be further tightened to further compress the buffer member 10 whereby the front of the drawer will be somewhat lowered. The drawer in its entirety will be inclined somewhat around its rear support which is formed by the elevation 7. The support lugs 12 follow this motion to a reduced extent.

Figure 6:
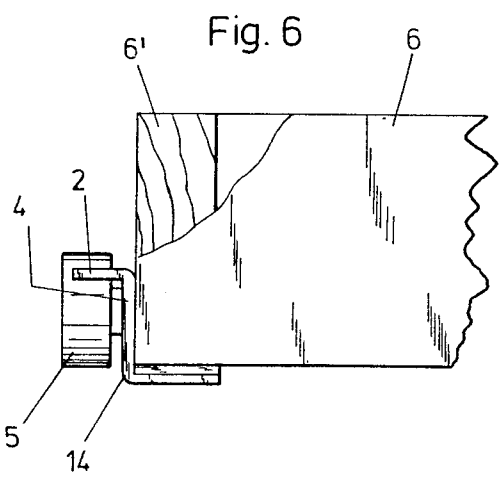
FIG. 6 is a front edge view of the assembly of FIG. 4.
Figure 4:
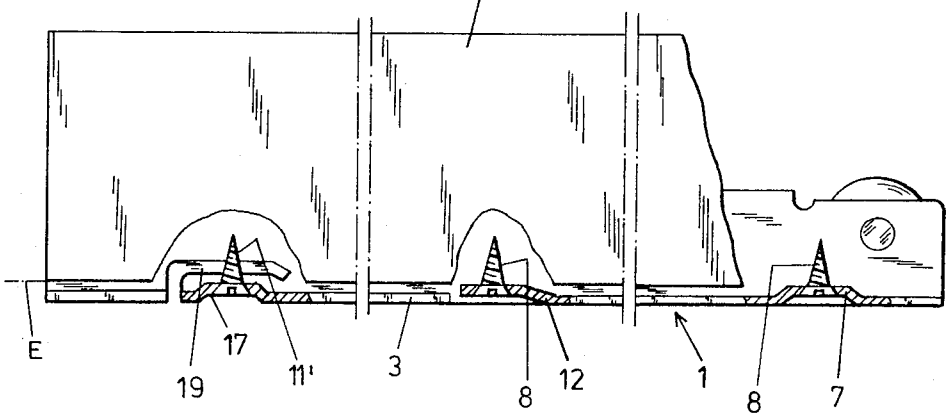
FIG. 4 is a side view of a second embodiment of the invention.
Figure 5:
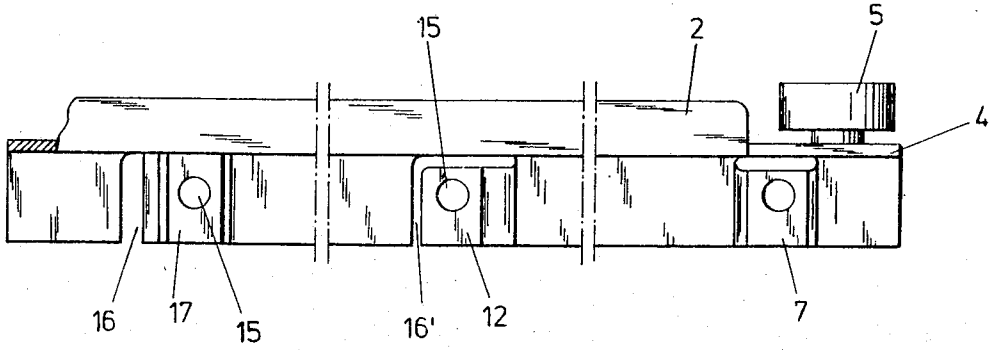
FIG. 5 is a top view showing the rail member of FIG. 4 with the drawer removed.

A further embodiment of the invention is shown in FIGS. 4–6 which generally correspond to the embodiment shown in FIGS. 1–3 with similar parts being identified with like reference numerals in FIGS. 4–6. The difference between the embodiment of FIGS. 1–3 and that of FIGS. 4–6 is that, in the embodiment of FIGS. 4–6, the front section of the lower horizontal support flange 3 is constructed differently. In the support flange 3, there is formed a support lug 17 by means of an L-shaped punchout or cutout 16, the support lug 17 having a through opening 15 extending therethrough to enable the fastening screw 11' to be attached to the underside of the drawer. The actual plane of the support lug 17 lies somewhat above the plane E of the horizontal support flange 3. One section of the L-shaped cutout 16 extends at right angles to the pullout section of the drawer and another section 19 of the cutout 16 extends parallel to the pullout direction of the drawer and passes over into the vertical web 4 of the rail member 1, as will be best seen from FIG. 4. During assembly of the drawer, all the fastening screws 8 to 11' are tightened. Corrections in the height of the front of the drawer are achieved in that a screwdriver blade is inserted in the section 19 of the L-shaped cutout 16 so that the flanks which are the terminal sides of the cutout section 19 are pressed apart and the drawer is somewhat lowered with respect to the plane E of the horizontal support flange 3. Should corrections be necessary in the other direction, a screwdriver blade may be inserted into the other section of the L-shaped cutout 16 which extends at right angles to the pullout direction of the drawer and by pressing upwardly, the support lug 17 is moved somewhat upwardly in order to thereby correct the position of the drawer relative to the base member.

As a result of the structures and assembly operations which are enabled by the present invention, it is possible for the correction of the vertical position of the drawer to introduce tensile as well as compressive forces into the drawer so that, as a result, not only are corrections possible which relate to the support surfaces as such, but also those corrections which may be necessary due to distortion of the drawer may also be accomplished.

In the embodiments shown in the drawings, the horizontally extending support flange 3 operates to serve, on the one hand, as a connecting element between the support lugs 12 and 17 and the vertical web 4, but it also serves, on the other hand, as a reinforcing element for the section. It would be within the scope of the invention to omit parts of this horizontal support flange insofar as they do not serve directly to effect transmission of forces.

Additional embodiments of the invention are shown and disclosed in FIGS. 7–14.

Figure 7:
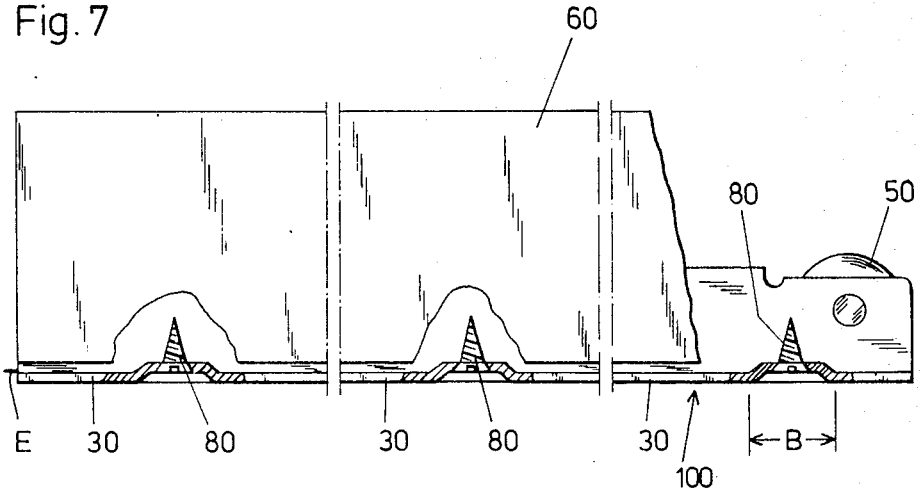
FIG. 7 is a side view showing a further embodiment of the invention.

In FIG. 7, there is shown a drawer rail 100 of a drawer mounting assembly with the other rails not being shown in the drawings. The drawer rail 100 is formed with a Z-shaped cross-sectional configuration, best seen in FIG. 8, with an upper horizontal side 20 and a lower horizontal side 30 and with a vertical web 40, the lower horizontal side 30 operating as the support flange of the invention in a manner similar to the support flange 3 of the embodiment in FIGS. 1–3.

Figure 8:
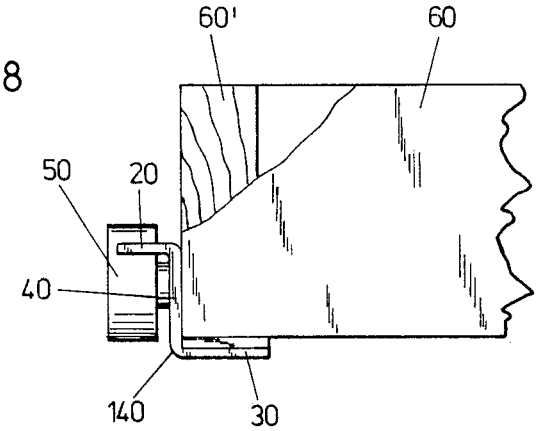
FIG. 8 is a front edge view of the assembly shown in FIG. 7.
Figure 9:
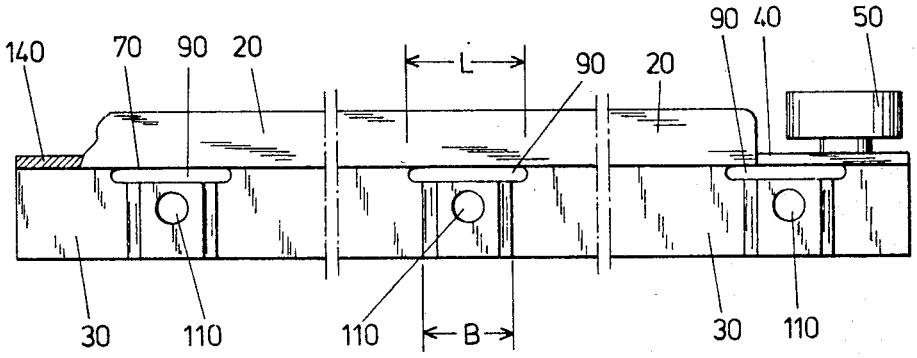
FIG. 9 is a top view of the rail member shown in FIG. 7 with the drawer removed.

In the embodiment of FIGS. 7–9, at the end of the rail 100, there is provided a freely rotatable roller 50 which is supported so that, during use, the rail 100 may be slidably guided relative to the base member upon which the drawer is to be mounted. A drawer 60 lies with its side walls 60' on the lower horizontal support flange 30.

The horizontal support flange 30 of the drawer rail member 100 has several bores 110 along its length which serve to hold fastening screws 80 which are turned in from the bottom into the side walls 60' of the drawer 60. Laterally of these bores 110 and adjacent to the vertical web 40, there is provided a longitudinal slot 90 which has a length which is at least twice the diameter of the bore 110 and which extends, taken relative to the longitudinal axis or longitudinal direction of the rail member 100, beyond the sides of the bore 110 on both sides thereof. The longitudinal slot 90 is arranged in such a way that its boundary edge 70 facing away from the bore 110 practically coincides with the plane of the vertical web 40. The area of the horizontal support flange 30 over which the longitudinal slot 90 extends is somewhat bent upwardly (see FIG. 7) so that the bore 110 lies on a level somewhat higher than the plane E of the horizontal flange 30. This upwardly bent portion is identifed by the letter B and it forms a deformable bending zone which serves for the necessary height correction if needed.

For assembly of the drawer mounting assembly of the invention, the rail member 100 is attached to the underside of the side wall 60' of the drawer 60 with fastening screws 80 which are turned in until they fit firmly. If it is found, after inserting the drawer into the base member, that it is not exactly assembled so that the front edges of the drawer do not extend horizontally, or in a case where several drawers are involved one above the other where uneven spaces occur, then this defect can be corrected by bending the portion of area B.

Figure 10:
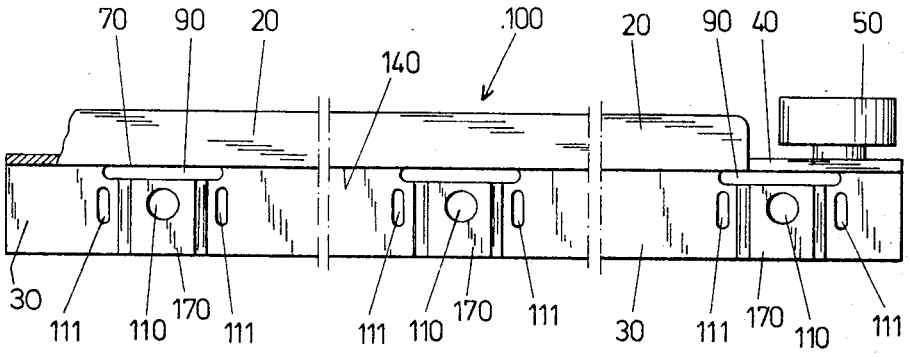
FIGS. 10, 11 and 12 are each top views showing further modifications of the rail member of the invention.

As shown in FIG. 10, it would be advantageous to arrange before and/or after the bore 110 transverse slots 111 at which a screwdriver blade could be applied if necessary.

Figure 11:
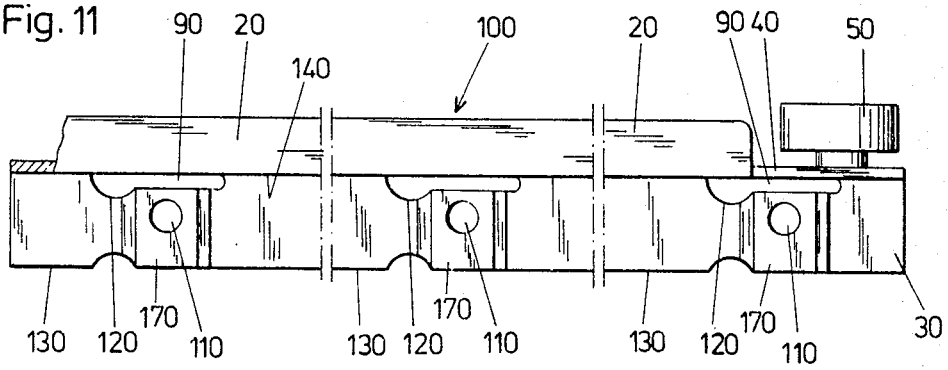
Figure 12:
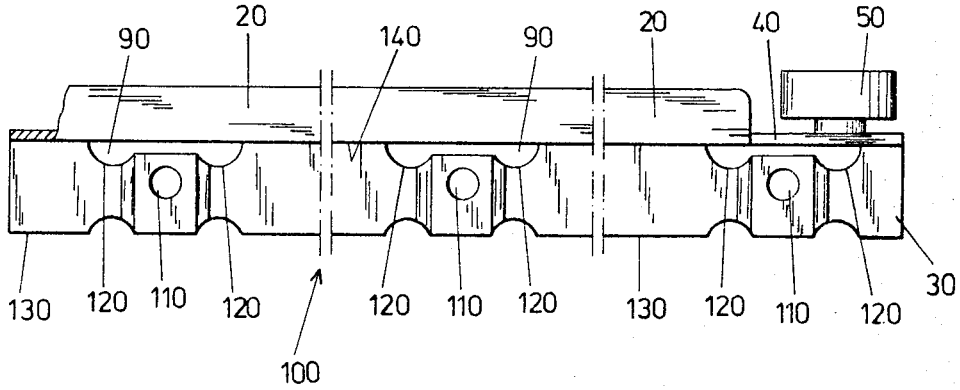

FIGS. 11 and 12 show other variations of the embodiment of FIGS. 7–9 wherein the boundary edge 120 of the slot 90 which lies adjacent to the bore 110 is formed with an arc shape in the area forwardly and/or rearwardly of the bore 110 toward the free edge 130 of the horizontal flange member 30 whereby simultaneously a considerable narrowing of the cross-section of the flange 30 is achieved thereby facilitating bending and deformation thereof and also facilitating the application of a suitable bending tool. The extent of this narrowing depends upon the actual load for which the drawer mounting assembly is intended. Bending of the part or area B with the bore 110 may be accomplished with conventional tools, such as screwdrivers and the like, but it is also possible to develop and construct a special tool for this purpose which could be made available to a furniture builder when assembling the drawer mounting assembly.

Due to the arrangement of the slot 90 in the immediate area of the bending edge 140 of the profiled rail member 110, bending of the horizontal support flange 30 during manufacturing of the profiled rail member 100 is considerably facilitated. The area B located above the plane E of the horizontal flange member having the bore 110 can, due to the teachings of the invention, be deformed to a considerable extent so that extensive corrections of the position are possible. Due to the measures developed by the invention, it is also possible to correct the vertical position by introducing tensile as well as compressive forces into the drawer so that in this manner not only corrections are possible which relate to the support surfaces as such, but also corrections which may be necessary due to distortion of the drawer may also be achieved. In the embodiment shown, the horizontal flange member 30 serves, on the one hand, as a connecting element between the support area B and the vertical web 40, but also serves as a reinforcing element for the section.

Figure 13:
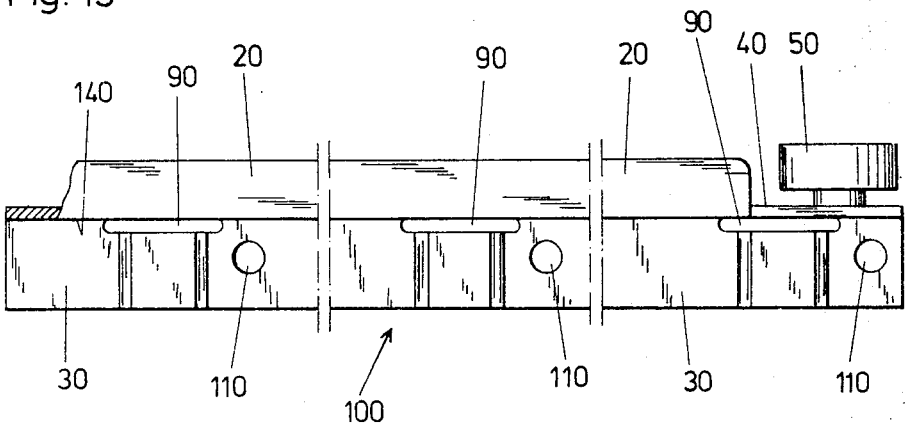
FIGS. 13 and 14 are, respectively, a top view and a side view of a rail member comprising an additional embodiment of the invention.
Figure 14:
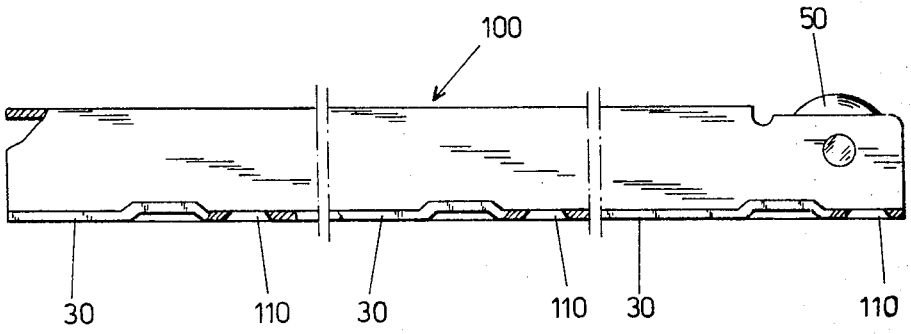

FIGS. 13 and 14 show an embodiment in top view and front view, respectively, wherein the upwardly bent sections B limited by the longitudinal slots 90 are laterally offset with respect to the bore 110 which hold the fastening screws 80. Basically the embodiment of FIGS. 13 and 14 generally corresponds to the embodiment of FIGS. 7–9. It is also possible in such an embodiment, where the upwardly bent areas B and the bores 110 which hold the fastening screws 80 are laterally offset with respect to one another, to construct the boundary edges of the longitudinal slots 90 in such a way as was described in connection with FIGS. 11 and 12.

In the embodiment according to FIGS. 13 and 14, the fastening screws lie laterally to the support areas on support sections B. Such an embodiment is not considered to be particularly advantageous although it is included within the scope of the invention. The disadvantage of such an embodiment, as compared to the ones discussed prior thereto, lies in that in the case of a correction of the support areas B by bending, possibly uncontrolled tensile stresses may be introduced into the drawer which are caused in that the support and fastening points are arranged at a distance from one another.

While specific embodiments of the invention have been shown and described in detail to illustrate the application of the inventive principles, it will be understood that the invention may be embodied otherwise without departing from such principles.

What is claimed is:

1. A drawer mounting assembly slidably mounting a drawer on a base member to enable said drawer to be withdrawn from said base member in a pullout direction, said drawer having a bottom side, said assembly comprising: a longitudinal rail member having a longitudinal dimension which extends parallel to said pullout direction and a support flange extending from said rail member essentially in a horizontal plane beneath said bottom side of said drawer over substantially the entire length of said rail member; slider means supporting said rail member in sliding engagement on said base member; lug means on said rail member connected with said support flange and adapted to be deformed to enable movement thereof relative to said horizontal plane; and connector means affixing said lug means to said bottom side of said drawer; said lug means being arranged to enable deformation thereof after attachment to said drawer thereby to adjust the position of said drawer relative to said base member during mounting thereof; said lug means comprising a first lug member which is located on said rail member at a rearward position taken relative to said pullout direction and which is located above said horizontal plane and a second lug member which is located forwardly taken relative to said pullout direction and which is located below said horizontal plane, with a resilient buffer member being provided between said bottom side of said drawer and said second lug member and with said connector means comprising screws fastening both said first and said second lug members to said bottom side of said drawer.

2. An assembly according to claim 1, wherein said resilient buffer member is formed with a through bore and wherein said screw fastening said second lug member to the bottom side of said drawer extends through said through bore.

3. An assembly according to claim 1, wherein intermediate said first and said second lug members, taken relative to the length of said rail member, there are provided additional lug members which are formed by forming L-shaped cutouts in said support flange, said additional lug members being connected with said support flange in a deformable manner.

4. A drawer mounting assembly slidably mounting a drawer on a base member to enable said drawer to be withdrawn from said base member in a pullout direction, said drawer having a bottom side, said assembly comprising: a longitudinal rail member having a longitudinal dimension which extends parallel to said pullout direction and a support flange extending from said rail member essentially in a horizontal plane beneath said bottom side of said drawer over substantially the entire length of said rail member; slider means supporting said rail member in sliding engagement on said base member; lug means on said rail member connected with said support flange and adapted to be deformed to enable movement thereof relative to said horizontal plane;

connector means affixing said lug means to said bottom side of said drawer; said lug means being arranged to enable deformation thereof after attachment to said drawer thereby to adjust the position of said drawer relative to said base member during mounting thereof; said lug means comprising at least one lug member which is formed by forming in said support flange a pair of cutouts, one of said cutouts extending on one side of said lug member in a direction perpendicularly to said pullout direction of said drawer and with the other of said cutouts extending on another side of said lug member in a direction parallel to said pullout direction of said drawer, said lug member being connected with said support flange on a third side thereof.

5. An assembly according to claim 4, wherein said rail member is formed with a vertical web which is integral with said support flange and which extends perpendicularly to said bottom side of said drawer, said cutout which extends parallel to said pullout direction of said drawer being provided immediately adjacent said vertical web.

6. An assembly according to claim 5, wherein said cutout which extends parallel to said pullout direction of said drawer is arranged to extend in said support flange directly at a bending edge between said support flange and said vertical web.

7. An assembly according to claim 5, wherein a plurality of said cutouts extending parallel to said pullout drawer direction are provided along said support flange adjacent said vertical web, said parallel cutouts having a length which is only a small fraction of the overall length of said rail member, said parallel cutouts being arranged to define lug members which are bent upwardly with relation to said horizontal plane and which serve to support said drawer.

8. An assembly according to claim 7, wherein said parallel cutouts are formed over a portion of their length to extend laterally of said support flange, each of said lug members defined thereby having a bore extending therethrough with the length of said parallel cutouts being at least twice as long as the diameter of said bores, said parallel cutouts extending longitudinally of said rail member to both sides of said bores.

9. An assembly according to claim 7, wherein each of said parallel cutouts has a boundary edge facing away from said bore which lies in the plane of said vertical web.

10. An assembly according to claim 8, wherein said horizontal support flange has an area taken forwardly and rearwardly of said bore which has a narrowing width.

11. An assembly according to claim 9, wherein said parallel cutouts are formed adjacent said vertical web and are shaped forwardly and rearwardly of said bores to have a wider dimension taken laterally of said support flange.

12. An assembly according to claim 11, wherein said parallel cutouts extend in an arc shape configuration forwardly and rearwardly of said bores.

13. An assembly according to claim 8, wherein both forwardly and rearwardly of said bores an additional slot is provided for enabling insertion of a tool.

* * * * *